United States Patent [19]

Mellor

[11] 4,087,948

[45] May 9, 1978

[54] FLOORING ELEMENTS

[75] Inventor: Peter Gordon Mellor, Chapel-en-le-Frith, England

[73] Assignee: Ferodo Limited, Manchester, England

[21] Appl. No.: 759,119

[22] Filed: Jan. 13, 1977

[51] Int. Cl.[2] ..... B44D 5/08

[52] U.S. Cl. ..... 52/180; 52/181; 52/581; 52/591

[58] Field of Search ..... 52/589, 591, 177, 180, 52/663, 664, 181, 581, 590; 404/19, 41, 44, 34, 35, 36

[56] References Cited

U.S. PATENT DOCUMENTS

| | | | |
|---|---|---|---|
| 729,923 | 6/1903 | Ellis | 52/177 |
| 1,409,125 | 3/1922 | Stanwood | 52/177 |
| 3,846,945 | 11/1974 | Roby | 52/177 |
| 3,909,996 | 10/1975 | Ettlinger, Jr. et al. | 52/177 |
| 3,913,291 | 10/1975 | Dulien et al. | 52/117 X |

OTHER PUBLICATIONS

*The Condensed Chemical Dictionary,* 8th Edition, G. Hawley, 1971, p. 711.

*Primary Examiner*—Ernest R. Purser
*Assistant Examiner*—Carl D. Friedman
*Attorney, Agent, or Firm*—William Anthony Drucker

[57] ABSTRACT

A flooring element having a moulded body and a partially raised surface which is of a material having a relatively high coefficient of friction, preferably the elements are provided with interlocking lugs so that a floor covering can be built up from a number of them.

10 Claims, 3 Drawing Figures

FLOORING ELEMENTS

This invention concerns improvements in or relating to removable flooring elements, for example of the kind which are commonly referred to as duck-boarding.

Accordingly to the present invention, a flooring element comprises a moulded body, having a partially raised surface which is of a material (hereafter referred to as "friction material") having a relatively high coefficient of friction.

Preferably the body has friction material also on the surface opposite the first-mentioned surface. It is preferred that the partially raised surface be composed of ribs of friction material and (optionally) additionally that the ribs be held in grooving in the said surface. Preferably also the body is provided with an open-work form; further preferably the body comprises means for interconnecting the flooring element with at least one other like element.

In one highly preferred aspect, the invention comprises a flooring element which has (i) a ribbed, open-work moulded body provided along two or more of its edges with a plurality of lugs which are spaced and profiled so that a lug or a pair of lugs on an edge of one such body can be engaged in the space between adjacent lugs on an edge of a like structure, and (ii) ribs of friction material secured to one surface of the body.

The body of flooring element preferably has attachment lugs on all sides and is of a suitable shape, e.g. square, to enable a plurality of elements to be built up, after the fashion of a jigsaw, into a covering for a desired area of floor. It is also preferred that the shape is such that a straight edged covering is produced, on which a simple straight edging strip can be provided.

The body preferably is formed by moulding, preferably injection moulding, a synthetic thermoplastics material such as polypropylene, preferably, stabilised against the action of degradative influences such as ultra-violet light. Preferably the friction material is resistant to degradative influences such as oil and chemicals. The present invention also provides a floor covering comprising a plurality of the aforesaid elements connected together.

Such a floor covering preferably includes an edge strip detachably mounted on a free edge of an element forming part of the covering; the edge strip may be profiled to provide a ramp surface.

A preferred embodiment of the present invention will now be described, merely by way of illustration, with reference to the accompanying drawings, wherein.

Figure 1:
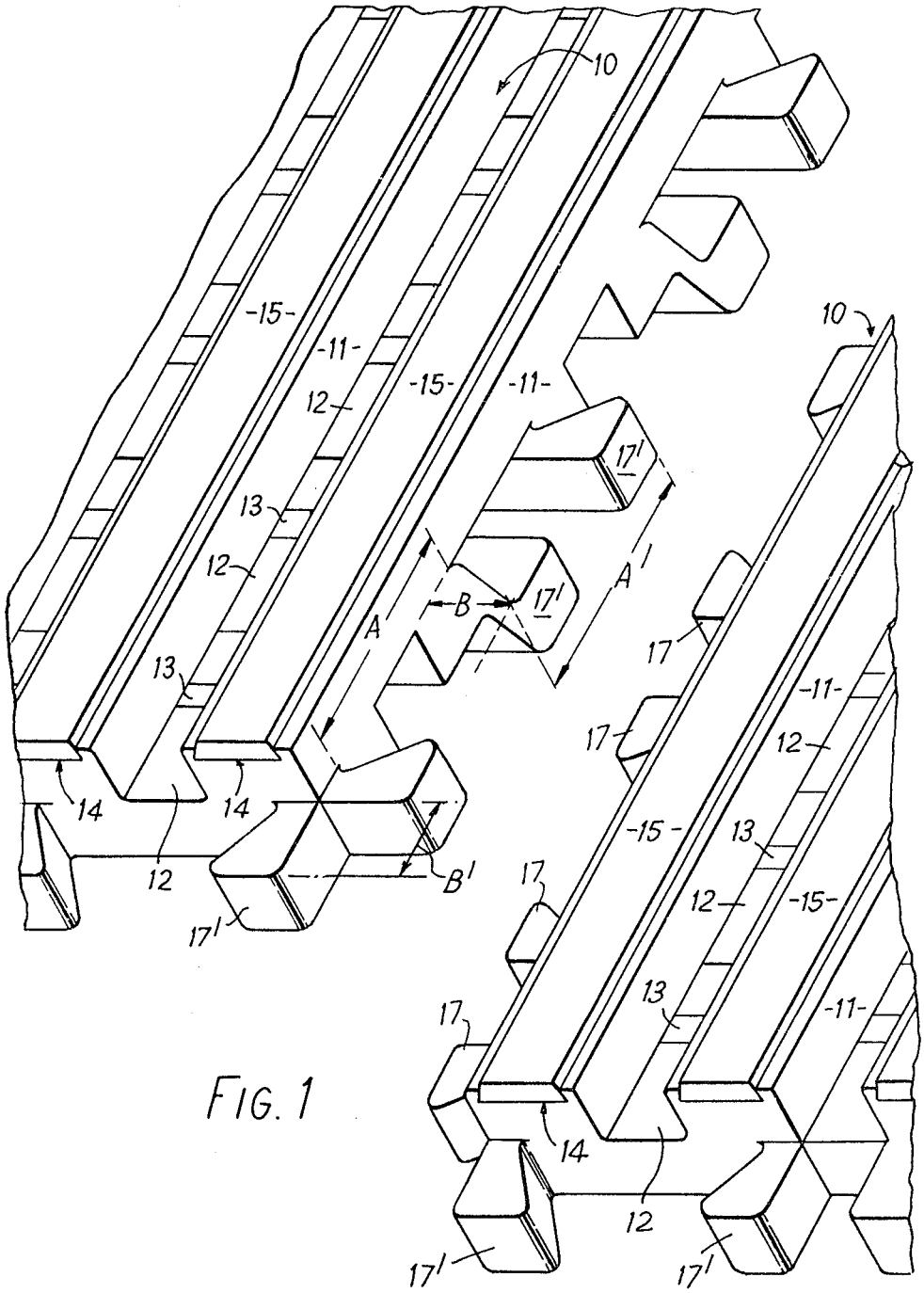
FIG. 1 is an isometric view from above of flooring elements.
Figure 2:
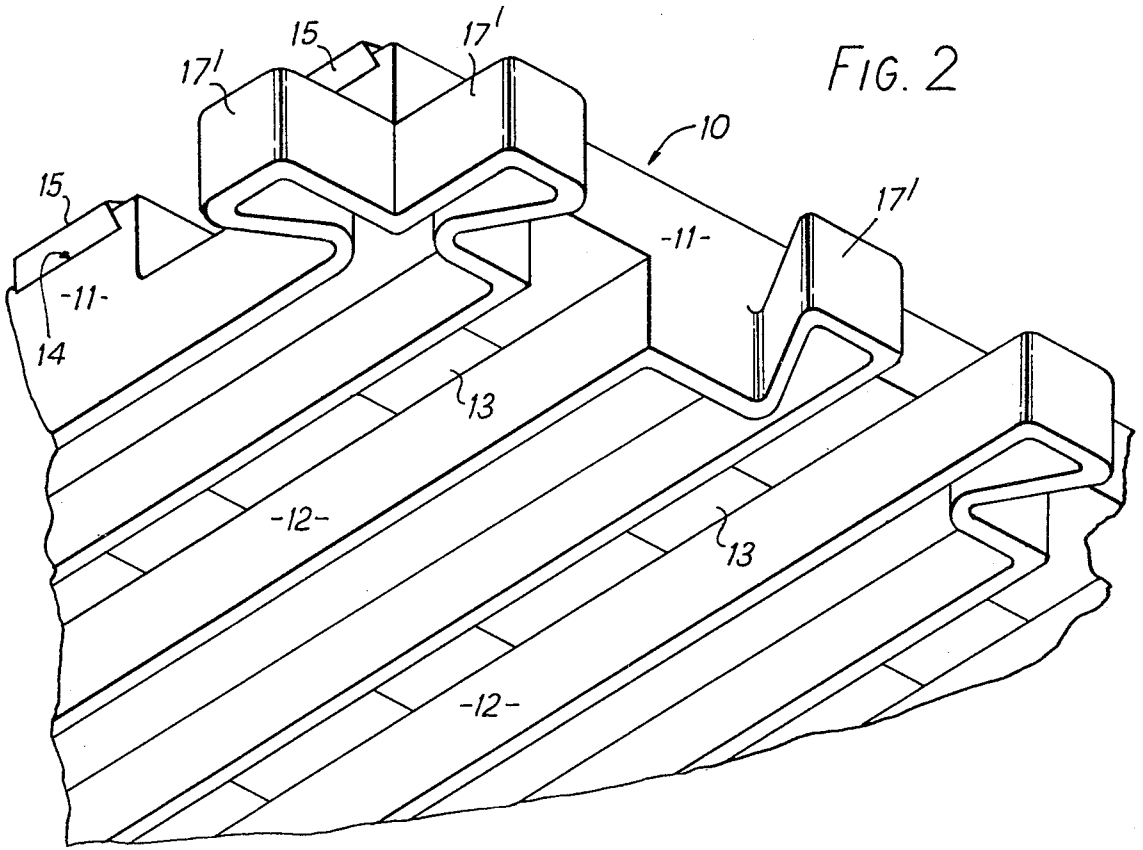
FIG. 2 is an isometric view from below of part of an element of FIG. 1.

Referring to FIGS. 1 and 2, a flooring element comprises a body 10 injection moulded in polypropylene stabilised against ultra-violet light; the body 10 is a monolithic open-work structure which may for convenience be considered to consist of a first set of spaced parallel bars 11 and a second set of spaced parallel bars 12 at right angles to the first set, providing openings 13. Moulded into the first set of bars are trapezoidal grooves 14 which receive strips 15 of friction material, of a corresponding trapezoidal cross-section which provides a discontinuous raised friction material surface over part of the upper surface of the body 10.

The edges of the body 10 are provided with profiled spaced lugs 17 and 17'; the dimensions A and B correspond to dimensions A' and B', respectively, but the arrangement of the lugs on two edges is different from that on the other two edges in the manner illustrated in FIG. 1. (compare the arrangement of lugs 17 with that of lugs 17').

In use, the flooring elements are laid on a floor, for example as a walk-way round a machine tool, the elements being connected together in an appropriate pattern by fitting the lugs 17 on one side of one element into the spaces between lugs 17' on a side of another element, in the manner of a jig-saw puzzle. If a plurality of lugs is provided on each edge, as in the embodiment described above, adjacent elements can be fitted together in 'staggered' formation.

It is desirable that the floor covering made up of the elements can be lifted as one piece for cleaning the floor beneath. The grip of the interlocking lugs is preferably adjusted by means of their rigidity and the degree of interference in the interlock between them to permit this end to be achieved whilst still maintaining ease of assembly.

Figure 3:
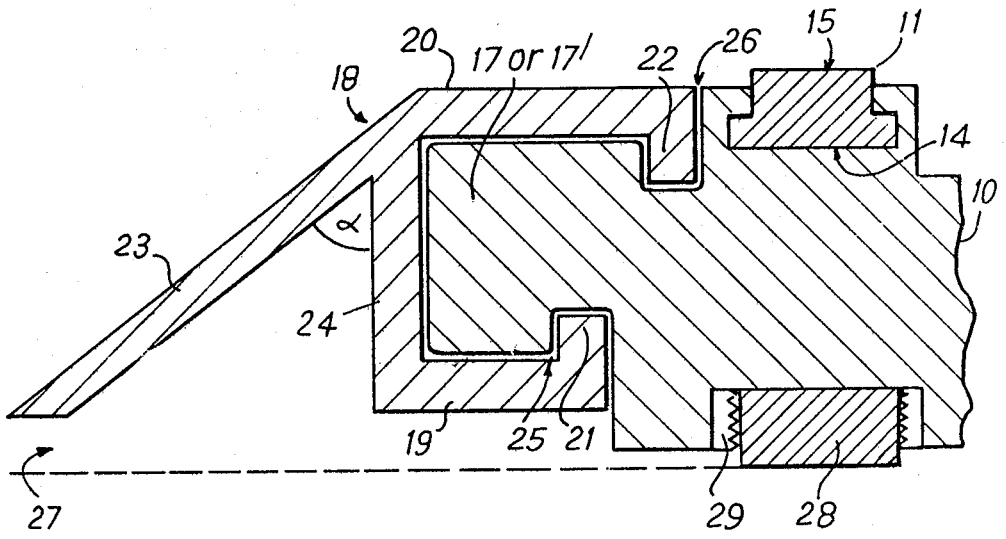
FIG. 3 is a cross-sectional view of an edge strip and a fragment of an element to which it is attached.

FIG. 3 shows one form of edge strip and a means of connecting it to a modified flooring element. In this embodiment, the edge strip 18 consists of an elongate member of extruded thermoplastic material such as PVC and has a generally U-shaped portion with one arm 19 shorter than the other arm 20; the arms 19 and 20 have inwardly turned ribs 21 and 22 respectively, and a flange 23 extends outwardly from and at an angle to the base 24.

The lugs 17 and 17' on the edges of the element 10 are positioned higher on the sides of the elements than those shown in FIGS. 1 and 2 and are grooved at 25 and 26 to receive the ribs 21 and 22 respectively. The edge strip can be mounted on the elements 10 either by sliding the ribs 21 and 22 longitudinally into the grooves 25 and 26, or by deflecting the arms 19 and 20 outwardly so that the ribs pass over the lugs and snap into the grooves. The edge strip may, of course, be of such a length as to 'edge' a number of interconnected elements. In the embodiment shown in FIG. 3, the flange 23 does not extend to the floor; the small gap 27 permits water or liquid waste to flow outwardly from beneath the elements 10.

In the modified flooring element the strips of friction material 15 have an inverted T-shape cross section, the grooves 14 in the rib 11 being correspondingly shaped.

The flooring element shown in FIG. 3 also includes pieces of friction material 28 on the side opposite the ribs 15, to assist in preventing the element from slipping on the floor. The pieces of friction material 28 are rectangular in cross-section and are received in internally ribbed inserts 29 secured in spaces on the underside of the element. The pieces 28 are of sufficient depth to raise the elements 10 above the floor so that water or liquid waste is able to flow out from under the elements.

The flange 23 provides a ramp for easy access of trolleys or other vehicles to the top of the floor covering.

In this specification, the term "friction material" is used to define materials of the general type used for stair treads in public service vehicles, or as 'decktread' in ships, or as friction lining materials in brakes and the like. A highly preferred material is one which will exhibit a relatively high coefficient of friction (compared to, say, that of the material of the body of the flooring element) under both 'wet' and dry conditions. An example of a suitable material is a nitrile-rubber/PVC blend containing an abrasive filler material such as sand.

I claim:

1. A flooring element comprising a body which is a single moulding having an upper layer of parallel elongated first bars and a lower layer of parallel elongated second bars, the first bars being disposed substantially at right angles to the second bars, the first bars being in spaced relationship to each other in said upper layer and the second bars being in spaced relationship to each other in said lower layer whereby said first and second bars together define a pattern of openings through the body, said first bars having a partially raised upper surface of material having a high coefficient of friction, said body further including at its edge a plurality of lugs extending therefrom at positions each corresponding to a respective aligned bar, said lugs being shaped to provide an undercut between the body and the remote end of the lug whereby the lugs of two flooring elements may be interengaged to interconnect the flooring elements, the width of the lugs being such that the width of a pair of interengaged lugs is no more than the width of the respective aligned bar, whereby the pattern of openings is maintained by the interengaged lugs.

2. A flooring element according to claim 1 in which the body has friction material also on the surface opposite to the partially raised surface.

3. A flooring element according to claim 1 in which the partially raised surface is composed of ribs of friction material.

4. A flooring element according to claim 3 in which the ribs of friction material are held in grooving in the body of the element.

5. A flooring element according to claim 1 in which the body has attachment lugs on all sides and is of a suitable shape to enable a plurality of elements to be built up, jigsaw fashion, into a covering for a desired area of floor.

6. A flooring element according to claim 5 in which the shape of the body is such that a straight edged covering can be built up.

7. A flooring element according to claim 1 in which the moulded body comprises polypropylene stabilized against the degradative influence of ultra-violet light.

8. A floor covering comprising a plurality of flooring elements as claimed in claim 1 connected together.

9. A floor covering according to claim 8 including an edge strip detachably mounted on a free edge of at least one element forming part of the covering.

10. A floor covering according to claim 9 in which the edge strip is profiled to provide a ramp surface.

* * * * *